US007809148B2

(12) United States Patent
Cobb

(10) Patent No.: US 7,809,148 B2
(45) Date of Patent: Oct. 5, 2010

(54) LOUDSPEAKER

(76) Inventor: Jason Myles Cobb, 6200 N. Golder St., Odessa, TX (US) 79764

( * ) Notice: Subject to any disclaimer, the term of this patent is extended or adjusted under 35 U.S.C. 154(b) by 951 days.

(21) Appl. No.: 11/444,322

(22) Filed: Jun. 1, 2006

(65) Prior Publication Data

US 2007/0280500 A1 Dec. 6, 2007

(51) Int. Cl.
*H04R 25/00* (2006.01)
*G10K 13/00* (2006.01)
*H04R 31/00* (2006.01)

(52) U.S. Cl. ..... 381/186; 181/163; 29/594

(58) Field of Classification Search ..... 381/150, 381/182, 185, 186, 342, 396, 397, 404, 419, 381/420, 423, 424, 432; 181/163, 171, 172; 29/594, 609

See application file for complete search history.

(56) References Cited

U.S. PATENT DOCUMENTS 1,844,787 A * 2/1932 Newill ..... 381/432
2,269,284 A 1/1942 Olson
2,496,589 A 2/1950 Marquis
3,213,209 A * 10/1965 Doelitzsch ..... 381/186
5,594,804 A 1/1997 Kim

FOREIGN PATENT DOCUMENTS

JP 57190496 11/1982
JP 59149497 8/1984

* cited by examiner

*Primary Examiner*—Brian Ensey
*Assistant Examiner*—Sunita Joshi
(74) *Attorney, Agent, or Firm*—Stephen R. Greiner

(57) ABSTRACT

A loudspeaker of improved construction includes a frame and a toroidal magnet that is affixed to the rear of the frame. The toroidal magnet has a central passageway that opens into the frame. A cap is affixed to the rear of the magnet and closes the central passageway. A guide rod is affixed to the cap and projects forwardly from the cap into the central passageway. A tubular former is slidably positioned upon the guide rod. A voice coil is wound about, and is affixed to, the tubular former. A forward cone has a narrow, rear end that is affixed to the tubular former and a wide, front end that is affixed to the front of the frame. A rearward cone has a narrow, rearward end with a central opening that loosely receives the tubular former between the rear of the frame and the rear end of the forward cone. The rearward cone also has a wide, forward end that is affixed to the frame rearwardly of the front end of the forward cone. A rearward spider is affixed to the rearward end of the rearward cone and is affixed to the rear of the frame. A forward spider is affixed to the rear end of the forward cone and is affixed to the forward end of the rearward cone.

1 Claim, 1 Drawing Sheet

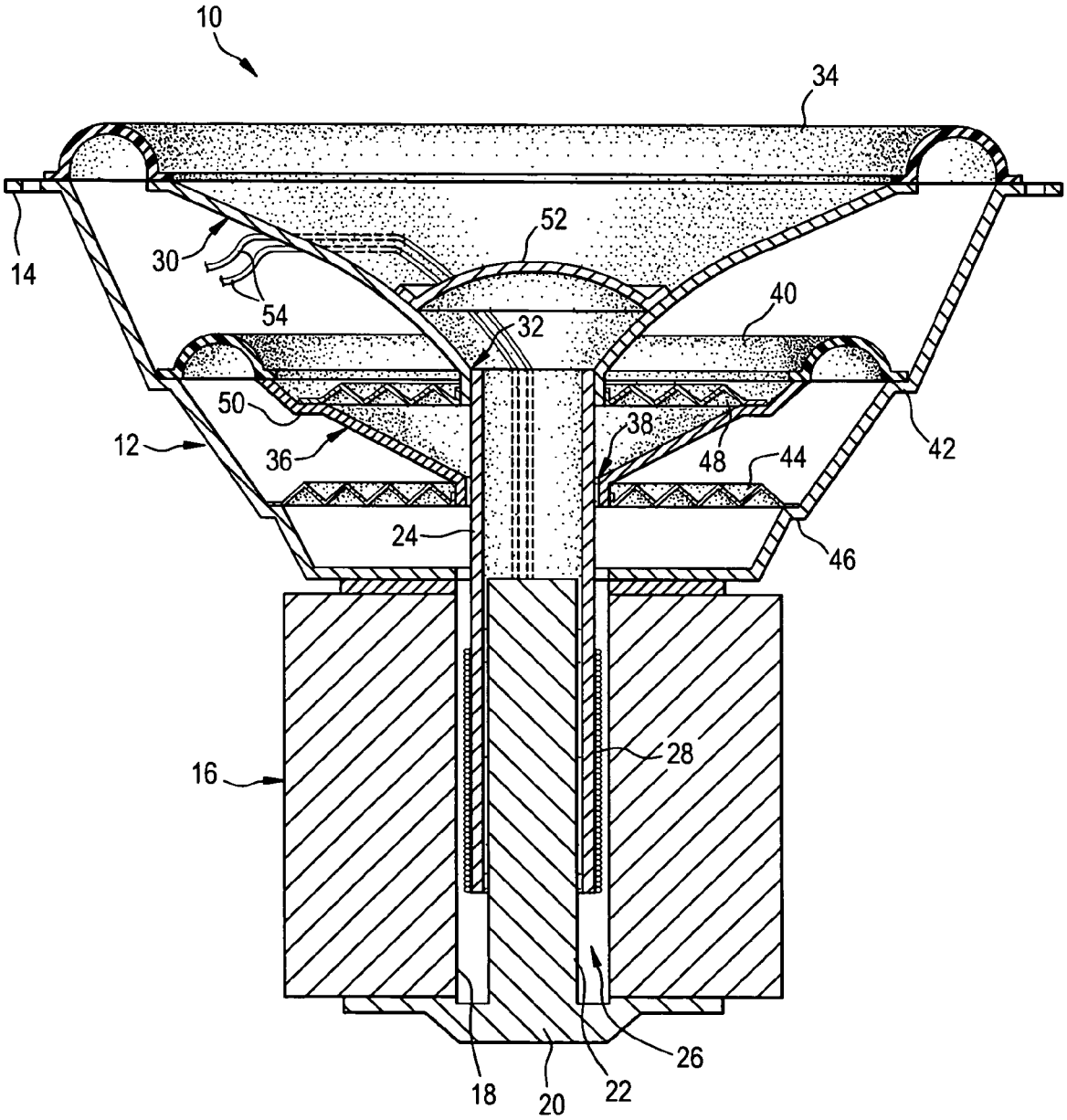
10
34
14
30
52
54
32
40
50
38
12
36
48
44
42
24
46
16
28
26
18
20
22

LOUDSPEAKER

FIELD OF THE INVENTION

The present invention relates generally to electrical audio signal processing systems and devices and, more particularly, to electro-acoustic audio transducers having plural diaphragms.

BACKGROUND OF THE INVENTION

A conventional loudspeaker includes a diaphragm or cone that is vibrated to move air in a piston-like manner and generate audible sounds. Typically, a radially corrugated device called a "spider" is secured to the cone to maintain the cone's position before, during, and after, sound-producing vibrations are induced. A spider permits the cone to move forwardly and rearwardly from its resting position with the full range of motion being known as "peak-to-peak excursion." As the peak-to-peak excursion of a loudspeaker cone increases, so does its ability to produce louder sounds, especially at lower frequencies.

Peak-to-peak excursion of a loudspeaker cone is often enlarged by increasing the diameter of the spider attached to the cone and by increasing cone diameter. Unfortunately, the small cabinets or other enclosures that are often expected to contain a loudspeaker place limits on the sizes of cones and spiders that can be used. Thus, the sound produced by many loudspeakers is less than satisfactory in terms of its quality and volume.

SUMMARY OF THE INVENTION

In light of the problems associated with the known loudspeakers, it is a principal object of the invention to provide a loudspeaker that features a pair of cones, with one positioned in front of the other, and a pair of supporting spiders that, together, increase the peak-to-peak excursion of the forward cone without increasing either: 1) cone/spider diameters or 2) loudspeaker power requirements. Also, the rearward cone drives air like the forward cone, effectively increasing loudspeaker output. Thus, loudspeaker sound volume limits can be increased, cost effectively, in space-restricted situations.

Another object of the invention is to provide a loudspeaker of compact size that can match the output, in terms of volume, frequency range, and quality, of a substantially larger loudspeaker of conventional construction.

It is an object of the invention to provide improved features and arrangements thereof in a loudspeaker for the purposes described that is lightweight in construction, inexpensive to manufacture, and dependable in use.

The foregoing and other objects, features, and advantages of the present loudspeaker will become readily apparent upon further review of the following detailed description of the preferred embodiment as illustrated in the accompanying drawing.

BRIEF DESCRIPTION OF THE DRAWING

The present invention is more readily described with reference to the accompanying drawing that is a vertical, cross-sectional view of a loudspeaker in accordance with the present invention.

DETAILED DESCRIPTION OF THE PREFERRED EMBODIMENT

Referring now to the drawing, a loudspeaker in accordance with the present invention is shown at 10. Loudspeaker 10 includes a conical frame 12 having an outwardly extending, peripheral, mounting flange 14 at its wide, front end and, also, having a narrow, rear end to which is affixed a toroidal magnet 16 with a central passageway 18 that opens into frame 12. A cap 20 is affixed to the rear end of magnet 16 that closes passageway 18. A guide rod 22, integrally formed with cap 20, projects forwardly from cap 20 and through passageway 18. A tubular former 24 is slidably positioned upon rod 22 in the annular space 26 located in passageway 18 between rod 22 and magnet 16. A voice coil 28 is wound about, and is affixed to, former 24 yet is spaced away from magnet 16. The narrow, rear end of a forward cone 30 is affixed to former 24 and is provided with a central opening 32 that snugly receives the front end of former 24. The wide, front end of forward cone 30, however, is affixed, by means of a resilient, ring-shaped, forward surround 34, to flange 14. A rearward cone 36 has a central opening 38 at its narrow, rearward end that loosely receives former 24 between the rear end of frame 12 and the rear end of forward cone 30. The wide, forward end of rearward cone 36 is affixed by a resilient, ring-shaped, rearward surround 40 to a forward, peripheral rim 42 in frame 12 approximately midway between the front and rear ends of frame 12. A rearward spider 44 encircles the rear end of rearward cone 36 and is affixed to the rear end of rearward cone 36 and to a rearward, peripheral rim 46 in frame 12 located between the rear end of frame 12 and rim 42. A forward spider 48 encircles the rear end of forward cone 30 and is affixed to the rear end of forward cone 30 and to a peripheral lip 50 at the front end of rearward cone 36. A dust cover 52 is affixed within forward cone 30. A pair of electrical leads 54 for energizing voice coil 28 extend upwardly from voice coil 28 and outwardly from forward cone 30, rearward of cover 52.

In use, voice coil 28 causes former 24 to vibrate longitudinally at predetermined frequencies, preferably low ones. Cones 30 and 36, being closely matched in terms of their sound production characteristics, respond simultaneously to the frequencies at which former 24 vibrates. The result is the production of base tones of high volume from a loudspeaker 10 of small size.

While loudspeaker 10 has been described with a high degree of particularity, it will be appreciated by those skilled in the art that modifications can be made to it. Therefore, it is to be understood that the present invention is not limited to the sole embodiment of a loudspeaker described above, but encompasses any and all embodiments within the scope of the following claims.

I claim:

1. A loudspeaker, comprising:

a frame;

a toroidal magnet is affixed to the rear of the frame, the toroidal magnet having a central passageway that opens into the frame;

a cap is affixed to the rear of the magnet and closing the central passageway;

a guide rod is affixed to the cap and projecting forwardly from the cap into the central passageway;

a tubular former is slidably positioned upon the guide rod;

a voice coil is wound about, and is affixed to, the tubular former;

a forward cone having a narrow, rear end and a wide, front end, the rear end is affixed to the tubular former, the front end is affixed to the front of the frame;

a rearward cone having a narrow, rearward end and a wide, forward end, the rearward end having a central opening that loosely receives the tubular former between the rear of the frame and the rear end of the forward cone, the forward end is affixed to the frame rearwardly of the front end of the forward cone;

a rearward spider is affixed to the rearward end of the rearward cone and is affixed to the rear of the frame; and, a forward spider is affixed to the rear end of the forward cone and is affixed to the forward end of the rearward cone.

* * * * *